US008479352B2

(12) United States Patent
Rivadulla Oliva

(10) Patent No.: US 8,479,352 B2
(45) Date of Patent: Jul. 9, 2013

(54) MOP BUCKET WITH TWO COMPARTMENTS

(76) Inventor: Carlos Rivadulla Oliva, Barcelona (ES)

( * ) Notice: Subject to any disclaimer, the term of this patent is extended or adjusted under 35 U.S.C. 154(b) by 118 days.

(21) Appl. No.: 12/990,453

(22) PCT Filed: Oct. 17, 2008

(86) PCT No.: PCT/ES2008/000650

§ 371 (c)(1),
(2), (4) Date: Nov. 22, 2010

(87) PCT Pub. No.: WO2009/133215

PCT Pub. Date: Nov. 5, 2009

(65) Prior Publication Data

US 2011/0061193 A1 Mar. 17, 2011

(30) Foreign Application Priority Data

Apr. 30, 2008 (ES) ..... 200800914 U

(51) Int. Cl.
*A47L 13/58* (2006.01)

(52) U.S. Cl.
USPC ..... 15/260; 15/264; 220/505

(58) Field of Classification Search
USPC ..... 15/260, 261, 262, 263, 264; D32/53, D32/54; 210/474; 220/501, 502, 553, 555, 220/505
See application file for complete search history.

(56) References Cited

U.S. PATENT DOCUMENTS

| | | | | |
|---|---|---|---|---|
| 3,383,732 | A * | 5/1968 | James et al. | 15/260 |
| 5,548,865 | A * | 8/1996 | Pagani | 15/262 |
| 2009/0019654 | A1 * | 1/2009 | Lingren | 15/115 |

FOREIGN PATENT DOCUMENTS

| | | | |
|---|---|---|---|
| DE | 40 38 303 | A1 | 6/1992 |
| ES | 1 003 943 | U | 8/1988 |
| ES | 1 026 224 | U | 4/1994 |
| ES | 1 039 205 | U | 11/1998 |
| ES | 1039205 | U * | 11/1998 |
| ES | 2 264 371 | A1 | 12/2006 |
| ES | 1 065 366 | U | 8/2007 |
| WO | 2004/105570 | A1 | 12/2004 |

* cited by examiner

*Primary Examiner* — Mark Spisich
*Assistant Examiner* — Andrew A Horton
(74) *Attorney, Agent, or Firm* — Sughrue Mion, PLLC

(57) ABSTRACT

Mop bucket with two compartments positioned horizontally, one for containing clean water and the other for containing dirty water, where each compartment is connected to its corresponding wringer. It comprises three pieces that can be coupled together: a first and main piece that comprises the clean water container, on whose mouth a second piece is coupled, comprising a compartment for dirty water, which is smaller in size and has a lower height, in such a way that after it has been fitted, its bottom is higher than the bottom of the main body, with two mouths for the whole bucket. Said whole is then finished off at the top with a third piece that can be coupled to it and which contains a pair of wringers that coincide with the mouths of each water compartment, together with an opening for the mop head to gain access to the clean water compartment.

17 Claims, 2 Drawing Sheets

MOP BUCKET WITH TWO COMPARTMENTS

This application is a National Stage of International Application No. PCT/ES2008/000650 filed Oct. 17, 2008, claiming priority based on Spanish Patent Application No. U 200800914 filed Apr. 30, 2008, the contents of all of which are incorporated herein by reference in their entirety.

PURPOSE OF THE INVENTION

This invention refers to a mop bucket with two compartments set out horizontally: one for clean water and the other for dirty water, where each compartment is connected to its corresponding wringer.

The purpose of the invention is to achieve a bucket which, besides offering the features of a bucket separated into compartments, separates clean water from the water used when mopping by means of two compartments separated horizontally, where each compartment is connected to its corresponding wringer. The bucket also offers a certain degree of stability when it is being used and moved, especially when wringing the head of the mop.

The purpose of the invention is also to simplify the bucket-construction process, based on shaping the bucket into three independent parts: the large or main bucket, used preferably for clean water; the small bucket, which is joined to the large bucket in its interior and positioned horizontally at the top; and the two wringers, which are located in one single piece that can be coupled to the corresponding main bucket as a cover. The layout of the piece that includes the wringers allows for the independent emptying of the water at both ends, i.e. from the clean water compartment and the dirty water compartment.

BACKGROUND OF THE INVENTION

There are already buckets with two compartments positioned vertically that make it possible to separate the clean water from the dirty water, keeping the clean water in good condition until it runs out.

Evidently, owing to the simplicity of the conventional buckets with two compartments positioned vertically, they are not stable when moved or when wringing the head of the mop. This is due to the fact that the compartments are positioned next to each other, side-by-side, which means that when the bucket is used initially, the water is stored in the clean water compartment, while the dirty water compartment is empty, and at the end of the process, the situation is reversed.

In whatsoever case, whether the water is in one compartment or the other, the instability is evident since the bucket, under such extreme or near-extreme conditions, has an empty or half-empty compartment and the other is full or half-full, which creates the instability when wringing the mop or moving the bucket.

To solve this problem, utility model 200700862 corresponding to the same applicant describes a bucket characterised by the fact that the two compartments are superimposed on each other horizontally, where one of them takes up approximately the bottom half of the body of the bucket, while the other takes up the remaining upper area, in such a way that access is gained to the lower compartment through a neck that crosses the upper compartment, where the top of said neck contains the corresponding wringer.

Although this layout solves the bucket instability problem, it has the disadvantage of a complex manufacturing process due to the horizontal middle wall that contains the neck to house the dirty water wringer, which evidently involves serious problems when implementing a manufacturing process by moulding.

DESCRIPTION OF THE INVENTION

The mop bucket that is being advocated here is of the type described in said utility model 200700862, corresponding to the same applicant and has the particular feature where the clean water and dirty water wringers are obtained by moulding a single-piece body that is then logically joined to the top of the bucket itself, with the special particularity that the dirty water and clean water compartments are made in such a way that the wall that separates them is not crossed by the neck with the top compartment wringer since, in this case, there is no neck, but rather a single-body piece that is joined to the top of the bucket and, on one side, there is the clean water wringer and, on the other side, the dirty water wringer, where the former is positioned opposite the compartment that takes up part of the bucket volume, whereas the other compartment takes up the rest of the volume and the bottom part of the bucket itself.

This obtains a bucket that can be manufactured simply by moulding, comprising three pieces that fit together: the body of the main bucket, the body of the upper bucket that fits in or is inserted in the body of the main bucket; and the unique piece that contains the two wringers.

It is also necessary to record the fact that the two compartments are positioned in such a way that the stability of the bucket is optimal since the centre of gravity of the bucket as a whole, regardless of whether one compartment is empty and the other full or the extent to which they are filled, will always be slightly in the centre to obtain the stability required for wringing the mop head in any of the two wringers. Furthermore, the upper piece that contains the two wringers is positioned preferably in the centre and diagonally and allows for two openings, or windows, on the ends of the bucket for emptying the unused clean water and the dirty water, which enables an efficient use of the water used for mopping.

DESCRIPTION OF THE DRAWINGS

In order to complement the description that is being made and to help gain a better understanding of the characteristics of the invention, in accordance with a preferable example of the practical use thereof, a set of drawings is attached as an inseparable part of said description, where said drawings provide illustrations of the following, without limitation.

PREFERENTIAL REALISATION OF THE INVENTION

Figure 1:
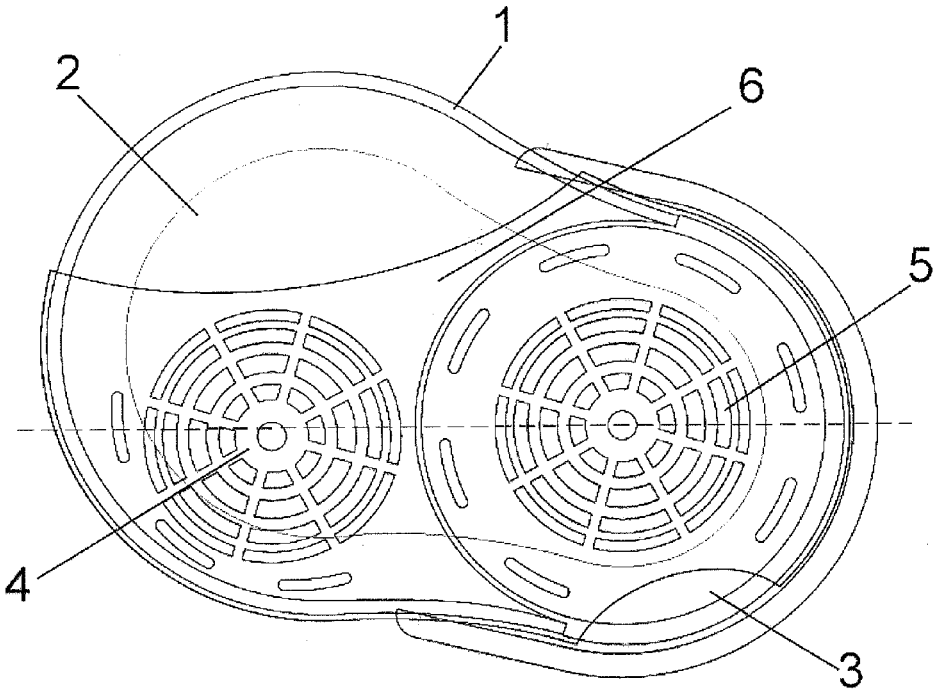
FIG. 1. This figure shows a schematic representation of the upper level of the mop bucket in accordance with the purpose of the invention.
Figure 2:
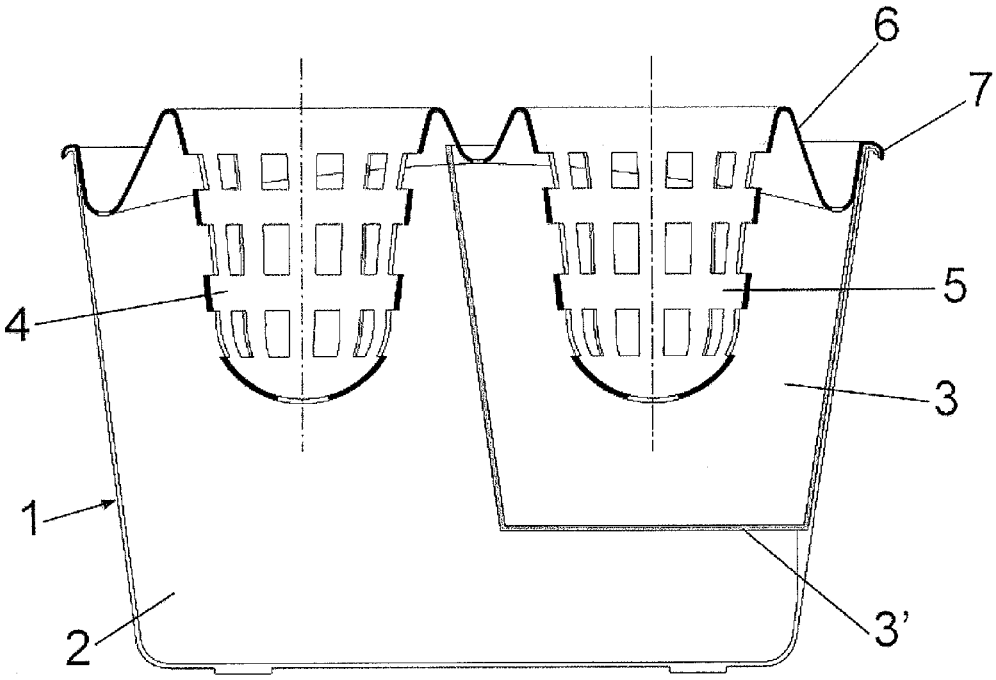
FIG. 2. This figure shows a side view and cross-section of the bucket shown in the previous figure, revealing the two wringers built into one single-piece body.
Figure 3:
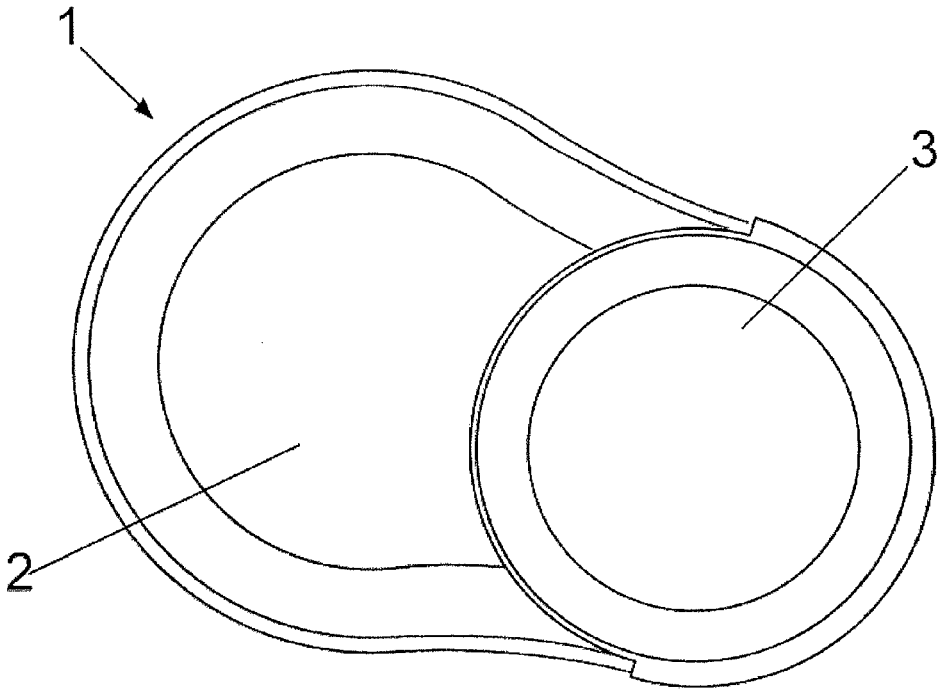
FIG. 3. This figure shows a layout view corresponding to the outline of the bucket, highlighting the dirty water compartment.
Figure 4:
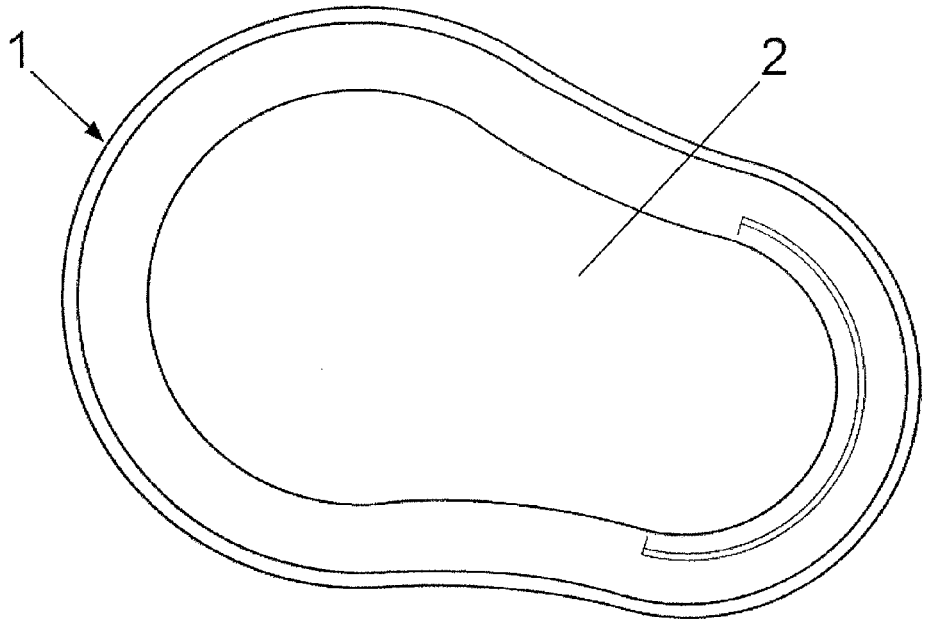
FIG. 4. This figure shows another layout view similar to the previous figure, but in this case it highlights the outline of the clean water compartment and does not show the outline of the dirty water compartment.

The foregoing figures show how the bucket in the invention is made of one container body (1), which can be given a pyramid or inverted-cone shape and in which a container body is inserted or coupled (3), the former for clean water, taking up one part of the bucket volume and the entire lower part of the bucket as shown in FIGS. 2 and 4, while the compartment (3) is for dirty water and has a preferable inverted-cone shape whose bottom (3') is notably above the bottom of the bucket (1) and, in particular, above the bottom of the clean water compartment (2)

The open upper parts of both compartments (2 and 3) take up approximately half the volume of the outline of the bucket mouth (1).

In whatsoever case, the corresponding wringers (4 and 5) for the clean water compartment (2) and the dirty water compartment (3) are made in a single-piece body (6) which, obtained by moulding, has the shape of two cups or wringers (4 and 5) and a perimeter edge (7) for coupling to the corresponding upper edge or mouth of the bucket (1), all in such a way that when the bucket contains only clean water in the corresponding compartment (2) and when the dirty water compartment (3) is empty, owing to the fact that said compartment (2) also takes up a lower part of the entire volume of the bucket, the bucket is stable when pressure is applied to the mop in any of the wringers (4 and 5) to wring the mop head; there is also an opening so that the mop head can gain access to the interior of the clean water container.

In addition, if the clean water compartment (2) is emptied and the dirty water compartment (3) is filled, the stability of the bucket (1) is maintained as a result of the positions of both wringers (4 and 5), which are positioned with one corresponding to the narrower area and the other to the wider area of the bucket itself, where consideration must be given to the fact that this advantageous and preferential shape will be kidney-shaped for said two parts or areas, one of which will be larger than the other, and each wringer will be positioned in one area or the other to achieve the stability of the bucket when it is being used or moved. Furthermore, the position of the upper piece, which includes the two wringers, allows for the inclusion of windows for emptying the clean water and dirty water from the corresponding containers. The position of said windows for emptying the water, preferably in the centre and diagonally, means that the corresponding containers can be emptied independently, without the need for emptying the water from both containers at the same time. This optimises the use and emptying of the water in each body, although it would be possible to use a single opening in the middle area for the simultaneous emptying of both compartments.

The invention claimed is:

1. A mop bucket with two compartments positioned in accordance with two parallel and horizontal planes, wherein the mop bucket is made of three parts that can be joined together:

a first main clean water compartment, on whose mouth, a second dirty water compartment is coupled, which has a smaller layout and lower height, in such a way that when fitted together, the bottom of the second compartment is higher than the bottom of the first main compartment and two mouths are defined for the mop bucket; and a third piece at the top, which can be coupled to the first main compartment and the second compartment and which contains a pair of wringers, formally and dimensionally appropriate for coinciding with the openings for accessing each of the first main compartment and the second compartment, as well as an opening providing the mop head with access to the clean water.

2. The mop bucket, according to claim 1, wherein the second compartment has an inverted-cone shape and takes up approximately half the volume of the mop bucket.

3. The mop bucket, according to claim 2, wherein the mop bucket has a kidney-shaped outline, where the smaller volume corresponds to the inverted-cone compartment and the area within the larger volume of the kidney-shaped outline corresponds to the compartment that takes up the entire lower section of the mop bucket.

4. The mop bucket, according to claim 1, wherein the mop bucket has a kidney-shaped outline, where the smaller volume corresponds to the second compartment and the area with the larger volume of the kidney-shaped outline corresponds to the compartment that takes up the entire lower section of the mop bucket.

5. The mop bucket, according to claim 1, wherein the upper piece that contains the pair of wringers has openings or windows on the ends that correspond to the ends of the mouths of the clean water and dirty water compartments to enable the independent emptying of one compartment or the other.

6. A mop bucket comprising:

a first compartment comprising a first closed bottom end, a first sidewall, and a first open top end;

a second compartment comprising a second closed bottom end, a second sidewall, and a second open top end wherein the second compartment is smaller than the first compartment and is configured to be removably disposed in suspension within the first compartment such that the second bottom end is positioned above the first bottom end when the second compartment is disposed within the first compartment;

a plate supported at least in part over the first compartment and the second compartment, the plate comprising a first wringer and a second wringer such that the first wringer is disposed within the first compartment and the second wringer is disposed within the second compartment, the top plate when positioned over the first compartment and the second compartment defines an opening into the first compartment for introduction of a mop head into the first compartment.

7. The mop bucket according to claim 6, wherein the first compartment has a general kidney shape comprising a first larger volume and a second smaller volume wherein the first larger volume is accessible directly through the opening in the top plate for introduction of the mop head and the second smaller volume received the second compartment.

8. The mop bucket according to claim 6, wherein the second compartment is almost half the volume of the first compartment.

9. The mop bucket according to claim 6, wherein the second compartment has an inverted cone shape.

10. The mop bucket according to claim 6, wherein the top plate is removably supported at least in part over the first compartment and the second compartment.

11. The mop bucket according to claim 6, wherein the first compartment has a lip along at least a portion of the first sidewall configured to engage a corresponding lip of the second compartment in order to support the second compartment in suspension.

12. The mop bucket according to claim 6, wherein the second open top end of the second compartment has a lip along at least a portion of the top end such that the second compartment can be disposed on at least a portion of the first sidewall of the first compartment.

13. The mop bucket according to claim 6, wherein at least one wringer is perforated to allow for water flow.

14. The mop bucket according to claim 6, wherein the first compartment and the second compartment have coinciding openings such that when tilted, dirty water from the second compartment pours into the first compartment and water from the first compartment pours out of the mop bucket.

15. The mop bucket according to claim 6, wherein the first bottom end of the first compartment is horizontal and parallel to the second bottom end of the second compartment.

16. The mop bucket according to claim 6, wherein the first bottom end of the first compartment forms the entire base of the mop bucket.

17. The mop bucket according to claim 6, wherein the first bottom end of the first compartment extends substantially over an entire base of the mop bucket and is positioned under the second compartment.

* * * * *